United States Patent [19]

Wright

[11] Patent Number: 4,594,500

[45] Date of Patent: Jun. 10, 1986

[54] ELECTRICALLY HEATED PUMP FOR SPAS AND SWIMMING POOLS

[75] Inventor: Murray J. Wright, Christchurch, New Zealand

[73] Assignee: Wright Spa Pools Ltd, Christchurch, New Zealand; a part interest

[21] Appl. No.: 464,423

[22] Filed: Feb. 7, 1983

[30] Foreign Application Priority Data

Feb. 10, 1982 [NZ] New Zealand ..... 199682

[51] Int. Cl.[4] ..... H05B 1/02; F24H 1/10; F04B 21/00; E04H 3/20

[52] U.S. Cl. ..... 219/296; 4/493; 165/108; 165/120; 219/306; 219/308; 415/121 R; 415/178

[58] Field of Search ..... 219/296–299, 219/302–309, 205, 208; 165/120, 121, 122, 108; 123/142.5 E, 142.5 R; 415/121 R, 178; 222/146.5; 4/493

[56] References Cited

U.S. PATENT DOCUMENTS

| | | | |
|---|---|---|---|
| 1,745,231 | 1/1930 | Prusacki | 219/208 |
| 1,750,170 | 3/1930 | Frisch | 165/120 X |
| 2,377,027 | 5/1945 | Morgan et al. | 219/306 |
| 2,419,273 | 4/1947 | Marquette | 219/305 X |
| 3,069,735 | 12/1962 | Toulmin | 219/306 X |

FOREIGN PATENT DOCUMENTS

| | | | |
|---|---|---|---|
| 648916 | 8/1937 | Fed. Rep. of Germany | 219/296 |
| 313882 | 6/1934 | Italy | 219/306 |

*Primary Examiner*—A. Bartis

*Attorney, Agent, or Firm*—Bert J. Lewen; Henry Sternberg

[57] ABSTRACT

A pump for a spa or swimming pool adapted to heat the liquid being pumped includes a rigid plastic housing fabricated from (1) a first housing part having a volute portion defining a suction chamber enclosing a pump impeller and having an outlet therefrom and a boss defining an inlet thereto and (2) a second housing part having a discharge outlet and a tubular inlet. A sleeve extends between the tubular inlet and volute portion boss to define a suction inlet to the suction chamber. A body extension inserted between the first and second housing parts defines a pressure chamber surrounding the suction inlet and suction chamber and in communication with the suction chamber outlet and discharge outlet. An electrical heater is positioned in the pressure chamber to heat the liquid pumped by the impeller and is controlled by temperature and pressure sensing devices positioned in the pressure chamber.

9 Claims, 2 Drawing Figures

ELECTRICALLY HEATED PUMP FOR SPAS AND SWIMMING POOLS

FIELD OF THE INVENTION

This invention relates to pumps and more particularly relates to a construction of pump for a spa or the like small pool, which is adapted to heat a fluid or liquid passing therethrough.

At present a large number of different types and constructions of pump are available for use with swimming or spa pools. Currently these pumps are used to pass water to a filter or heater where the water is filtered or heated before it is reused. In most instances and in particular in small domestic situations separate pumps, filters and heaters have been used. The applicant in his New Zealand Patent Specification No. 180899 has gone some way to overcoming the additional cost involved in having separate appliances. The construction described in this specification is a unique combination heater and filter unit adjacent to which is normally positioned an electrically powered pump. Additional cost is incurred in the manufacture of the separate mouldings from which the respective pump and filter/heater are built.

Pumps of the type commonly used with small swimming or spa pools are electrically operated and are built from parts manufactured in an injection moulding machine from generally rigid plastic materials. The parts include a number of moulded sections which are bolted together to form therein a first chamber and a second chamber with an impeller therebetween which draws a liquid through a generally tubular first or inlet chamber to a boss shaped volute section with the impeller situated therein and which has a series of ports which communicate with the second chamber formed around the tubular inlet and volute section.

An object of the present invention is to provide a pump and heater unit for a spa or the like small pool.

SUMMARY OF THE INVENTION

According to a broadest aspect of the present invention there is provided a pump and heater unit including a moulded, fabricated or cast housing which has therein first and second chambers. The first or suction chamber has an inlet formed therein or is connected to a member with an inlet formed therein and an impeller in association therewith, and the second or pressure chamber has an outlet from the housing and is in communication with the first or pressure chamber so that the impeller, driven by a device means associated with the housing, can be operated to create a flow of a fluid or liquid from the first chamber to the second chamber past at least one heating element mounted in the first or second chambers to heat the fluid or liquid.

According to a second aspect of the present invention there is provided a method of manufacturing a pump and heater for a spa or the like small pool, the method including the steps of:

casting, fabricating or moulding a housing from one or more parts to form a first or suction chamber and a second or pressure chamber;

inserting in the housing an impeller which creates a flow of fluid or liquid from an inlet formed in the first chamber past the impeller and from an outlet formed in the second chamber;

placing in the first and/or second chambers at least one electrical heating element; and assembling the housing to thereby constitute a heater pump for a spa or the like small pool.

The first chamber as hereinbefore defined can be formed from a number of sections from parts which form parts of the housing and which are bolted or fixed together during assembly thereof. The sections can include a hair and lint strainer casing and an inlet casing which when assembled together form the first chamber in which the electrical heating element or elements can be situated.

The second chamber as hereinbefore defined can be formed from a number of parts which when assembled together with the parts forming the first chamber form the housing.

According to a third aspect of the present invention there is provided a method of modifying a spa or the like small pool pump including the steps of:

disassembling the parts of a housing thereof in which a first and second chamber are formed;

inserting a volute extension between an inlet port in one part of the housing and a volute near an impeller mounted in association with another part of the housing;

inserting a body extension between the one part of the housing and the said another part of the housing; and reassembling the housing to thereby form an enlarged second chamber and lengthened first chamber in which at least one electrical heating element is inserted.

According to a fourth aspect of the present invention there is provided a swimming pool or spa pool pump including a moulded, fabricated or cast two part housing which when connected together form first and second chambers. The first chamber is formed as an inlet or suction chamber at one end of which is an impeller and which has a communicating port or ports which communicate with and the second chamber, the second chamber has an outlet or outlets from the housing formed therein, the invention being characterised by the inclusion in the inlet or suction chamber of a sleeve and the insertion of a body extension between the first and second parts of the housing to form enlarged first and second chambers in either or both of which an electrically operated heating element is positioned to thereby form a pump heater.

The first part of the housing can include at one end thereof part of a tubular inlet and part of the second chamber which is annular in section and through which the tubular inlet extends, and the second part of the housing can include the remainder of the second chamber and either integrally therewith or as a separate fitting inserted therein a hollow central boss shaped volute section in which an impeller is fitted and which has the port or ports therein which communicate with the second chamber when the parts are assembled, the arrangement being such that the sleeve is positioned between the tubular inlet and the boss section and the body extension is fitted between the two parts.

The body extension can include mountings for an electrical heating element and a support for a probe in which automatic water temperature and pressure sensing means are situated and which automatically shut down the unit in the event of failure thereof.

The housing can be constructed from a rigid plastic material formed in a number of separate parts in an injection moulding machine.

Further objects of the present invention will become apparent from the following descriptions which are given by way of example only.

BRIEF DESCRIPTION OF THE DRAWINGS

Embodiments of the present invention will now be described with reference to the accompanying drawings in which.

DESCRIPTION OF THE PREFERRED EMBODIMENTS

Figure 1:
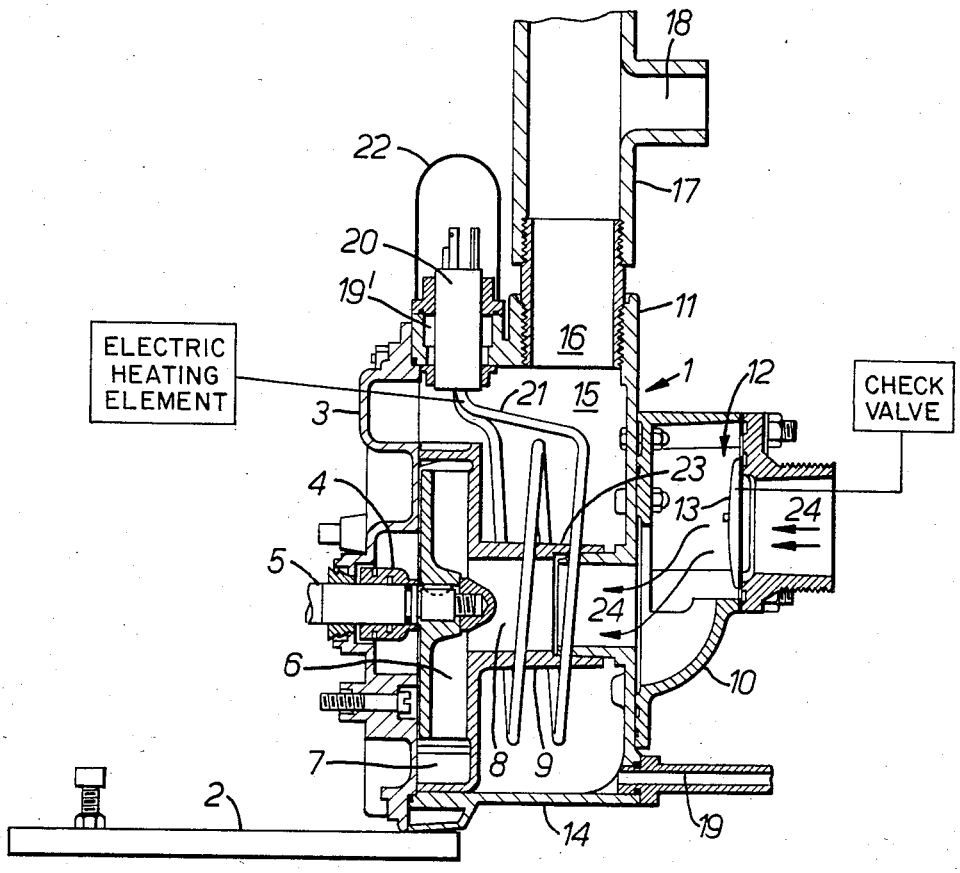
FIG. 1: shows a section through a first example of pump heater according to the present invention.

In FIG. 1 the pump and heater unit is a moulded, fabricated or cast unit which has a housing generally indicated by reference numeral 1 which is mounted on a base plate or mounting 2. The base plate 2 supports a drive unit (not shown) for the pump.

The housing 1 is formed from at least two and in the drawing four moulded plastic shells. The first shell 3 supports a bearing 4 through which extends a drive shaft 5 from the drive unit.

The drive shaft 5 supports an impeller 6 within a first or suction chamber 7. The suction chamber 7 is shaped to include a suction inlet 8. The suction inlet 8 is formed from parts of second, third and fourth shells 9, 10 and 11 respectively. The third shell 10 forms an inlet port 12 in which a check valve 13 can be sited. Alternatively or additionally the third shell 10 can support a hair or lint strainer 48 or other equipment associated with an inlet to a pump. The fourth shell 11 has a cylindrical outer region 14 which with part of the first shell 3 and the outer casing of the second shell 9 forms a second or pressure chamber 15. The second chamber 15 is in communication with the first chamber 7 by ports (not shown) in the second shell 9, i.e. the volute which can surround the impeller 6.

The second chamber 15 has therein an outlet 16 from the housing which constitutes the outlet from the pump and to which, in use, appropriate pipes and ancilliary equipment are attached. For example in a spa pool situation a conduit 17 is fixed to the outlet 16. The conduit 17 has an extension 18 in which safety controls, for example, temperature controls, a water sensitive activation switch and a pressure switch can be included.

The second chamber 15 also has a drain outlet 19 in the base thereof so that the chambers 3 and 15 can be drained for maintenance or inspection purposes.

The cylindrical outer region 14 of the fourth shell 11 has therein an aperture 19' through which a connector 20 on an end of an electrical heating element 21 extends. The connector 20 is connected by electrical wiring (not shown) to a power supply through appropriate protection and safety devices. The aperture 19' is covered by a cap 22 to seal the fittings therein. The element 21 can be as shown a continuous element wound around boss or volute extension 23 which is formed by the second and third shells 9 and 10 and constitutes part of the suction inlet 8 of the first chamber.

In practice the connector 20 and element 21 are fitted in the aperture 19' before the fourth shell 11 is joined with the third shell 10 to the partly fabricated first and second shells 3 and 9.

The parts of the pump are fitted together with O-ring seals or the like in accordance with common practice in this industry.

In use the pump and heater unit is connected as required to a spa or the like small pool. In the example described the pipe from the pool is connected to the inlet port 12 so that water or fluid is drawn through the suction inlet 8 by the impeller 6 in the direction of the arrows 24. The water is forced by the impeller 6 into the second chamber 15 where it is heated if the element 21 is operating before the water is forced from the outlet 16. Any back flow of water can be minimised by including the check valve 13 and if included the inflow can be strained by a lint and hair strainer 48.

Figure 2:
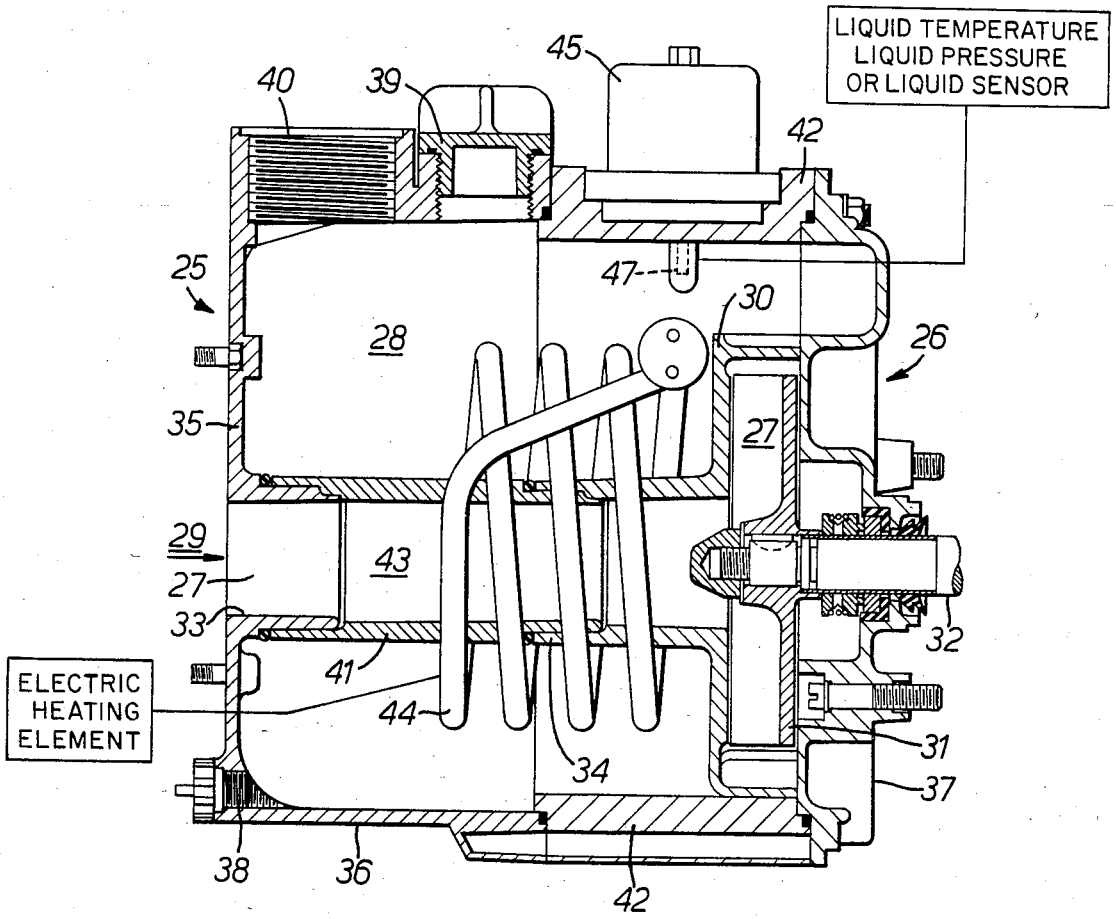
FIG. 2: shows a section through an alternative construction of pump heater according to the present invention.

In the alternative construction of pump and heater unit shown in FIG. 2 is a standard pump which is cast or moulded in two parts is modified to constitute a heater pump according to the invention. In this example the standard pump normally includes a two part housing injection moulded from a plastic material. The first part 25 and second part 26 when normally assembled form a first or suction chamber 27 and second or pressure chamber 28. The first chamber 27 includes a suction inlet 29 and a volute region 30 in which an impeller 31 is mounted. The volute region 30 can be a separate shell inserted between the first and second parts 25 and 26 after the impeller 31 is fitted. The impeller 31 is driven in normal manner by a drive shaft 32 connected to a motor (not shown). The suction inlet 29 is formed by a tubular inlet 33 formed as part of the first part 25 and a hollow central boss or volute section 34 formed as part of the second part 26. The first part 25 also constitutes an end wall 35 and a cylindrical outer wall 36 of the second chamber 28 so as to form an annular (in section) chamber which is in communication with the region 30 in which the impeller 31 is mounted through at least one port (not shown) around the periphery of the region 30.

The other end wall 37 of the second chamber 28 is formed by the second part 26.

In use, in the past, such a pump for spa or swimming pools is bolted together and used in the normal manner. The first part 25 has therein a drain plug 38, priming port 39 and an outlet 40 through which water is driven to return same to a spa or the like small pool.

The present invention requires such a pump to be modified by the inclusion of a sleeve 41 and a body extension 42. The sleeve 41 is fitted so that one end is within the boss section 34 and the other end is over the tubular inlet 33. This forms an extended suction inlet 43.

The body extension 42 increases the size of the second chamber 28 to enable a heating element 44 to be inserted. The heater element 44 is in the example a coil and it is to be appreciated that other shapes of element can be used. The mounting (not shown) for the element 44 is formed in the periphery of the extension 42. The extension 42 also includes mountings 45 for heater/-pump accessory equipment. The accessory equipment can include electronic temperature and water pressure sensitive devices for automatic operation and shut down. In the example a probe 47 including thermo and liquid sensors is included.

The applicant has discovered that the inclusion of the volute extension (sleeve 41) and the body extension 42 decreases water turbulence in the first and second chambers and this in turn increases the pump flow rate, by volume.

Thus by the inclusion of the sleeve 41, body extensions 42, heater 44 and control equipment there is produced a more efficient pump with the added advantage of providing water heating.

It is to be appreciated that in either example the heater element can alternatively be situated in the volute extension or in a hair and lint strainer fitted adjacent the inlet to the housing.

Thus by this invention there is provided a pump and heater unit for spa or the like small pools.

Particular examples of the present invention have been described herein by way of example and it is envisaged that improvements and modifications thereto can take place without departing from the scope and spirit of the appended claims.

What I do claim and desire to obtain by Letters Patent of the United States is:

1. A swimming pool and spa pump, including a fabricated housing containing:

(a) a first housing part having a volute portion define a suction chamber in which is mounted to a pump impeller, said suction chamber having an outlet therefrom and said volute portion having a boss defining an inlet to said suction chamber;

(b) a second housing part having a discharge outlet and a tubular inlet;

(c) a sleeve extending between said tubular inlet and said volute boss to define a suction inlet to said suction chamber;

(d) a body extension disposed between the first and second housing parts to define a pressure chamber surrounding said suction inlet and said suction chamber and being in communication with said suction chamber outlet and the discharge outlet;

(e) a heating element within said housing adapted to heat liquid flowing therethrough.

2. A swimming pool and spa pool pump as claimed in claim 1 wherein the second part of the housing has at one end thereof said tubular inlet and defines part of the pressure chamber which is annular in section and through which the tubular inlet extends, the first part of the housing defines a portion of the pressure chamber and said volute portion has at least one port therein which communicates with the pressure chamber when the parts are assembled.

3. A swimming pool and spa pool pump as claimed in claim 2 wherein the body extension includes mountings for said heating element and a probe in which automatic water temperature and pressure sensing means are situated.

4. A swimming pool and spa pool pump as claimed in claim 3 wherein the housing is constructed from a rigid platic material.

5. A pump and heater unit as claimed in claim 4 wherein the housing has a drain outlet and a priming port communicating with the suction and pressure chambers, respectively.

6. A swimming pool and spa pool pump as claimed in claim 1 wherein the second part of the housing has at one end thereof said tubular inlet and defines part of the pressure chamber which is annular in section and through which the tubular inlet extends, the first part of the housing defining a portion of the pressure chamber and having attached thereto a separate fitting defining said volute portion in which said impeller is fitted and which has at least one port therein which communicates with the pressure chamber.

7. A method of maufacturing a pump and a heater, including the steps of:

(a) fabricating a plastic housing including (1) a first housing part having a volute portion defining a suction chamber, said suction chamber having an outlet therefrom and said volute portion having a boss defining an inlet to said suction chamber, and (2) a second housing part having a discharge outlet and a tubular inlet;

(b) mounting in the volute portion of said first housing part a pump impeller;

(c) inserting a sleeve between the tubular inlet and the volute boss to define a suction inlet to the suction chamber;

(d) inserting a body extension between the first and second housing parts to define a pressure chamber which surrounds the suction inlet and the suction chamber and which is in communication with the suction outlet chamber and the discharge outlet;

(e) placing in at least one of said chambers at least one electrical heating element.

8. The method of claim 7 which additionally includes incorporating in said housing electric temperature and water pressure sensitive devices for controlling operation of said at least one electrical heating element.

9. The method of claim 7 wherein the at least one electrical heating element is inserted in the pressure chamber.

* * * * *